United States Patent [19]

Molick

[11] 4,075,800

[45] Feb. 28, 1978

[54] FOUNDATION AQUADUCT AND EXPANSION JOINT

[76] Inventor: Medea Molick, 8001 Mulligan Ave., Burbank, Ill. 60459

[21] Appl. No.: 766,874

[22] Filed: Feb. 9, 1977

[51] Int. Cl.[2] ..... E04B 1/70; E04F 17/00

[52] U.S. Cl. ..... 52/169.5; 52/303; 52/573; 137/362

[58] Field of Search ..... 52/573, 198, 302, 303, 52/169.5, 287, 288; 137/362

[56] References Cited

U.S. PATENT DOCUMENTS

| | | | |
|---|---|---|---|
| 1,734,777 | 11/1929 | Pike | 52/169.5 |
| 1,903,244 | 3/1933 | Reed | 52/287 |
| 2,703,002 | 3/1955 | Suskind | 52/302 |
| 2,717,513 | 9/1955 | Smart | 52/303 |
| 2,948,993 | 8/1960 | Marchi | 52/169.5 |
| 3,332,185 | 7/1967 | Adams | 52/169.5 |
| 3,850,193 | 11/1974 | Guzzo | 52/169.5 |
| 3,975,467 | 8/1976 | Beck | 52/303 |
| 3,990,469 | 11/1976 | Ralston | 52/287 |

*Primary Examiner*—John E. Murtagh
*Attorney, Agent, or Firm*—Hill, Gross, Simpson, Van Santen, Steadman, Chiara & Simpson

[57] ABSTRACT

Water leakage and seepage through foundation walls into basements, cellars and the like, is collected in a trough-like duct positioned on the inner face of the foundation near the bottom thereof and drained into a sump. In one form of the invention, the trough-like duct is positioned between the concrete flooring and the foundation of the basement or cellar and drains into conventional drainage tiles underneath the flooring. In another embodiment, the trough-like duct is secured on top of the concrete flooring against the inner face of the foundation wall and is drained directly into a sump or drainage conduit for the basement floor. Interior wall paneling for the basement can extend into the open top of the duct. In another embodiment, existing basement flooring can be routed adjacent the foundation wall forming a channel to receive the trough-like duct of this invention. In those installations where the duct is positioned between the basement flooring and the foundation wall, the duct will act as an expansion joint. In those installations where the duct is exposed at the level of the basement floor, perforated covers can be snapped into the open top of the duct to prevent entry of solid objects. The ducts are preferably formed of extruded plastic, although metal can also be used.

5 Claims, 8 Drawing Figures

FOUNDATION AQUADUCT AND EXPANSION JOINT

FIELD OF THE INVENTION

This invention relates to the art of foundation and flooring constructions for basements and particularly deals with collection of water leakage and seepage through the foundation walls to prevent drainage to the occupied area of the basement.

SUMMARY OF THIS INVENTION

According to this invention, a duct system is provided on the inner faces of basement foundation walls below or adjacent the basement flooring to collect and drain any water seepage through the foundation before it reaches an occupied area of the basement. In a preferred embodiment of the invention, an open top channel-like plastic duct is secured to the inner face of the basement foundation just above the foundation footing and is connected by tubing to drain tile adjacent the footing. The basement flooring is poured over the footing and drain tile to a level substantially flush with the open top end of the duct. The duct thus lies between the inner face of the foundation and the periphery of the concrete basement floor to serve as an expansion joint as well as a trough for collecting and draining water leaking through the foundation. The duct is preferably channel shaped with flat sides and an open top into which can be fitted a perforated or screened cover allowing flow of liquid therethrough but preventing solid objects from falling into the duct. The duct and cover are preferably formed of extruded plastic materials such as polyvinyl chloride but they can also be formed of extruded metal or bent sheet metal. The ducts and covers can be furnished in conveniently handled lengths of, say, from five to twenty feet and have a depth of about three inches and a width of about ¾-inch.

In another embodiment of the invention adapted for installation on pre-existing foundation and floor structures, the duct can be secured on the basement floor and against the inner face of the foundation and drained through tubing communicating with the conventional floor drainage opening. In this arrangement, the duct forms a floorboard and can receive the lower end edges of paneling mounted over the foundation wall.

In still another embodiment of the invention useful in pre-existing structures, the periphery of the basement floor at the foundation wall can be routed in the area of seepage or leakage to form a trough for receiving the duct of this invention and the duct can then be drained into the basement sump or floor drainage outlet.

In securing the duct over the floor and to the foundation wall, waterproof mastic adhesive can be used so that seepage below the open top of the duct will be blocked until it can drain into the open top of the duct.

It is then an object of this invention to provide a combination water-collecting duct and expansion joint for basement foundation walls and floors.

Another object of this invention is to provide a water-collecting duct system around the periphery of a basement floor to prevent leakage of water through the foundation into the occupied area of the basement.

Another object of the invention is to provide a water seepage collecting system for basements.

A specific object of the invention is to provide an easily installed inexpensive duct system for mounting on foundation walls to prevent leakage of water into the occupied area of the basement.

Other and further objects of this invention will be apparent to those skilled in this art from the following detailed description of the annexed sheet of drawings which shows several embodiments of the invention.

Figure 1:
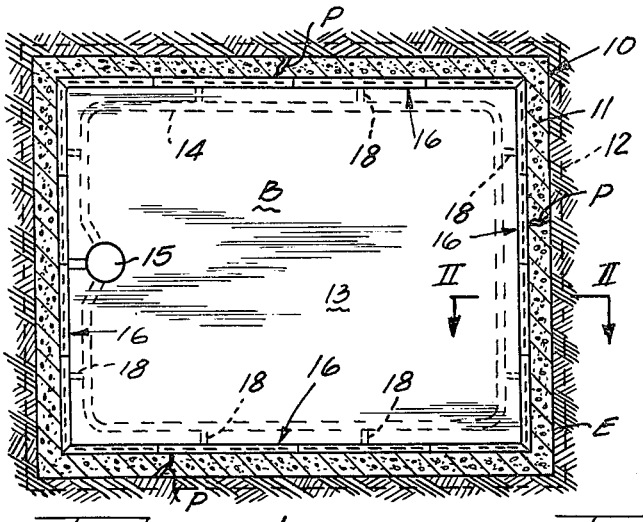
FIG. 1 is a horizontal section taken through the foundation of a building having a concrete basement floor, shown in plan, and equipped with an aquaduct system according to this invention.

AS SHOWN ON THE DRAWINGS:

In FIG. 1, the reference numeral 10 designates generally a building foundation with upright concrete foundation walls 11 around a basement area B supported on concrete footing 12. The basement B has a concrete floor 13. The foundation walls 11 are surrounded by earth E.

Figure 2:
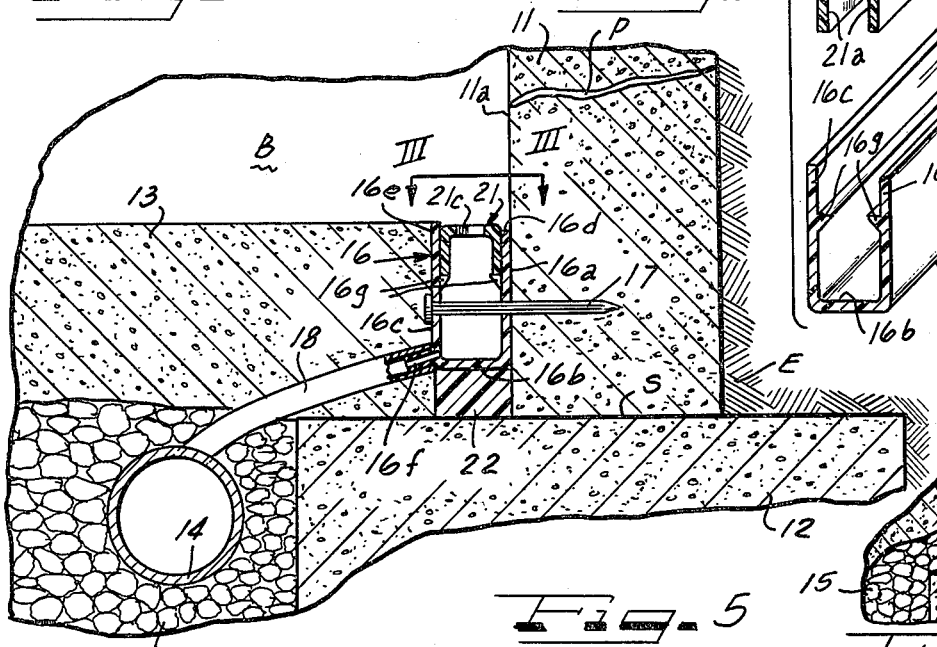
FIG. 2 is a fragmentary, enlarged cross-sectional view taken along the lines II—II of FIG. 1.

As better shown in FIG. 2, the concrete footing 12 extends beyond the inner face **11*a* of the foundation wall 11 underneath the wall 11 and as is conventional in basement foundation construction, drain tile 14 is buried in gravel or the like filling 15 surrounded by the footing 12 and underlying the floor 13. The tile 14 as shown in FIG. 1 extends under the concrete floor 14 around the periphery of the basement B. This drain tile drains into a conventional sump or other drain outlet 15**.

In accordance with this invention, prior to pouring the concrete flooring 13, an open top U-shaped duct 16 is secured to the inner face **11*a* of the foundation walls at a level above the footing 12 to lie flush with the top surface of the thereafter poured concrete floor 13. The duct 16 has a flat upstanding outer wall or leg 16*a* lying against the inner wall 11*a* of the foundation 11, a horizontal bottom wall 16*b* positioned above the footing 12 and a flat upstanding inner wall or leg 16*c* surrounding the concrete floor 13. Fasteners such as concrete nails 17 extend through the walls 16*c* and 16*a* into the foundation 11 to tightly press the upstanding sidewall 16*a* of the duct against the inner face 11*a* of the foundation 11. The nails 17 may pierce the sidewalls 16*c* and 16*a*** or holes may be drilled through the sidewalls to snugly receive the nails.

The top edge **16*d* of the outer wall 16*a* of the duct 16 is somewhat below the top edge 16*e* of the inner duct wall 16*c* to lie at a level slightly below the top surface of the concrete floor 13 which is flush with the top edge 16***e*.

Figure 3:
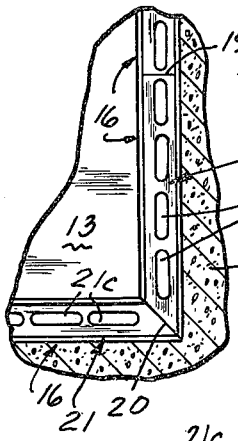
FIG. 3 is a fragmentary plan view with parts in horizontal section and taken along the line III—III of FIG. 2.

Drain nozzles 16*f* extend from the bottom of the duct 16 at spaced intervals and receive tubing 18 thereover communicating with the drain tile 14. As shown in FIG. 1, this tubing 18 may project from each duct section and, thus, a plurality of tubes 18 will serve the drain tile 14. The lengths of the duct section may vary widely as desired to be easily handled and to fit the construction requirements. As shown in FIG. 3, adjoining duct sections are tightly butted together at 19 and bevel corner butt joints 20 are also provided. The joints between the sections can be sealed with mastic, covered with tape or otherwise treated to prevent leakage therebetween.

Figure 4:
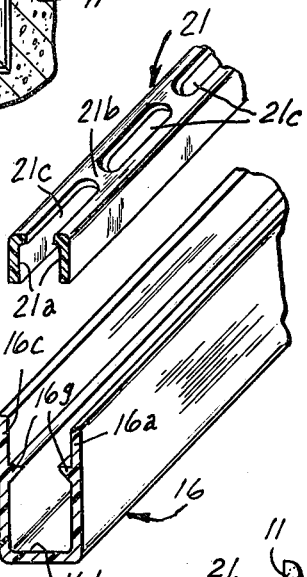
FIG. 4 is an exploded perspective view of interfitting plastic duct and cover components of this invention.

As shown in FIGS. 2 and 4, the duct sections 16 are preferably extruded plastic material such as a polyvinyl chloride plastic and have thickened internal ribs or beads 16*g* at about the midpoints of the upstanding sidewalls 16*a* and 16*c* forming shoulders supporting a plastic channel shaped cover 21 for the open top of the duct 16. This cover 21 has flat depending sidewalls 21*a* snugly fitting between the sidewalls 16*a* and 16*c* of the duct 16 and a flat top wall 21*b* with openings 21*c* at spaced intervals along the length thereof. The cover 21 is adapted to be pressed or snap-fitted into the duct 16 to rest on the shoulders of the beads 16*g* and each cover section may have a convenient length so as to be easily inserted and removed from the duct. The openings 21*c* are small enough to prevent small objects from falling into the duct 16. A screen top could also be provided for the cover 21.

Since the duct 16 is secured to the foundation wall 11 so that its top edge 16*e* will determine the floor level for the concrete floor 13, a gap will be provided between the top of the footing 12 and the bottom 16*b* of the duct. This gap is filled with any suitable deformable filler such as foam plastic strips 22 and after the flooring 13 is poured, these strips will be confined under the duct 16.

Since the duct 16 is preferably formed of extruded plastic material or is formed from sheet metal, it can be tightly pressed between the foundation wall and the concrete flooring and will be sufficiently resilient to "breathe" for accommodating any relative expansion and contraction of the flooring and foundation wall. This "breathing" is unimpeded by the filler material 22 so that relative expansion or contraction due to temperature changes, shrinkage and the like will not stress either the floor 13 or the foundation wall 11.

However, in the event of leakage paths such as "P" opening up in the foundation wall, due to cracking, improper settling of the concrete, etc. any water leaking through the foundation wall from the surrounding earth E into the inner face 11*a* of the foundation wall at a level above the duct 16, will drain through the openings 21*c* into the duct and be conveyed through the tubes 18 to the drain tile 14 and out of the basement area from the sump 15. Likewise, any seepage of water "S" under the foundation 11 will be either directly drained into the drain tile 14 or will rise to a level above the edge 16*d* of the duct 16 from which it will drain into the duct. Since the top edge 16*d* of the duct 16 is lower than the top edge 16*e*, the duct will collect the water before it can flow onto the floor 13 which is at a higher level.

Figure 6:
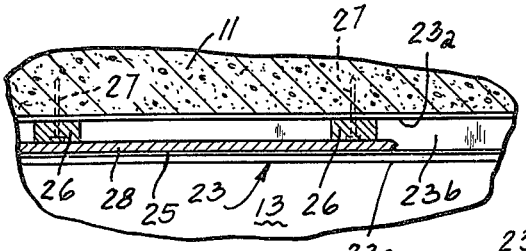
FIG. 6 is a horizontal cross-sectional view taken along the lines VI—VI of FIG. 5.
Figure 5:
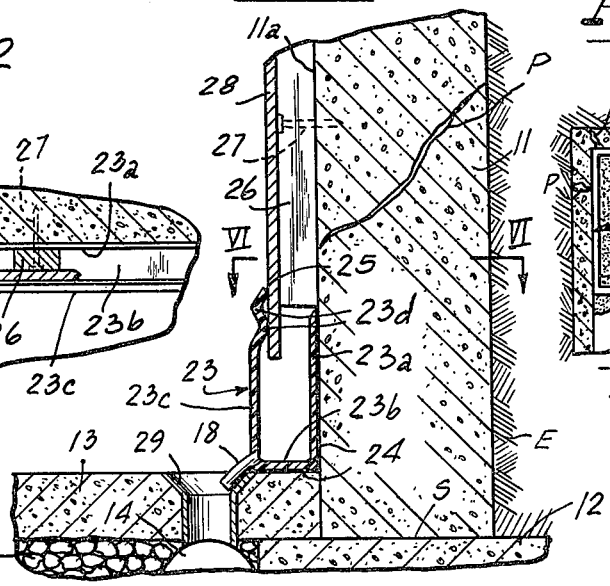
FIG. 5 is a fragmentary vertical sectional view through a foundation wall and basement floor showing a modified duct arrangement according to this invention receiving a panel mounted on the foundation wall.

In the modification shown in FIGS. 5 and 6, the same reference numerals are used to designate the identical components described hereinabove. However, as shown in FIGS. 5 and 6, a U-shaped open top duct 23 is mounted on top of the basement floor 13 against the inner wall 11*a* of the foundation 11. This duct 23 has a flat upstanding outer wall or leg 23*a* and a flat bottom wall 23*b* both covered with a waterproof adhesive 24 which will bond to the concrete foundation wall 11*a* and top surface of the floor 13. The adhesive 24 may be integrally bonded with the walls 23*a* and 23*b* at the time of manufacturing the duct 23 and covered with a tear-off tape which is removed to apply the duct to the concrete surfaces or the adhesive may be applied as a mastic at the time of installing the duct.

The duct 23 has an upstanding inner leg or wall 23*c* longer than the outer wall or leg 23*a* to extend to a level above this wall. The upper end of the wall 23*c* is corrugated at 23*d* to form a spring finger 25.

Upstanding furring strips 26 are secured to the inner face 11*a* of the foundation wall 11 by means of fasteners 27 and paneling or plaster board 28 is secured to these furring strips to form a finished inner wall for the basement. This paneling or plaster board extends into the duct 23 and is tightly engaged by the spring finger 25 so that the duct 23 cooperates with the panel 28 to provide a finished floorboard effect for the panel. Tubing 18 connects the bottoms of the duct 23 at intervals with the drain conduit 14 and may conveniently merely communicate with a floor drain 29 leading to a sump or to the drain tile 14.

Leakage paths "P" through the foundation wall 11 will drain into the duct 23 and water seepage S under the foundation wall 11 will also drain into the duct being sealed from flowing under the duct by the mastic adhesive 24.

Thus, the duct system 23 of FIGS. 5 and 6 operates in the same manner as the duct system 16 of FIGS. 1 to 4 with the exception of the omission of the expansion joint feature.

Figure 7:
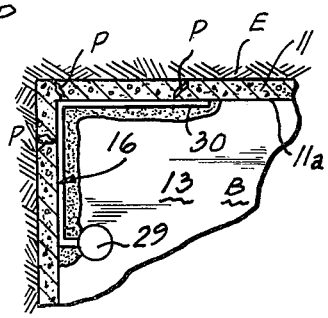
FIG. 7 is a fragmentary horizontal view of a foundation wall and basement floor showing another embodiment of the duct of this invention.

As shown in FIG. 7, a duct 16 of this invention may be installed in a finished basement foundation and floor construction at a local area where leakage paths "P" have developed through the foundation wall 11. As shown, the flooring 13 and the inner face 11*a* of the foundation wall are routed at their intersection to form a groove 30 of sufficient depth to receive the duct 16 at a level to accept the drainage through the leakage paths "P". The duct 16 is then drained into a floor drain or the like 29. Since the duct 16 does not surround the entire periphery of the basement floor 13, it will have end walls at its extremities.

Figure 8:
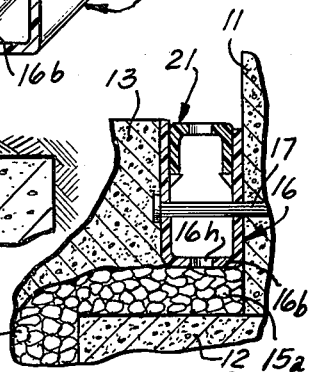
FIG. 8 is a view similar to FIG. 2 but showing a modification where the aquaduct system drains into gravel underlying the floor.

As shown in FIG. 8, where the same reference numerals used in FIG. 2 identify the same things, the use of drain tile 14 and tubes 18 can be dispensed with in installations such as shown in FIG. 2 by draining the duct 16 directly into gravel or other porous material 15 underlying the floor 13. In this modification, the gravel 15 extends over the footing 12 up to the wall 11 and under the duct 16 filling the space occupied by the filler 22 in the FIG. 2 embodiment. Holes such as 16*h* are provided in the bottom 16*b* of the duct 16, draining the duct into the gravel for dissipation. This modification is useful where drain tiles 14 are not needed or even where they are used and receive water from the gravel instead of directly from the duct 16. The term "gravel" as used herein covers any porous filler such as stones, sand, plastics material and the like capable of draining water.

While concrete foundation walls 11 have been shown, it will be understood that other construction materials, such as cinder block, can be used.

From the above descriptions, it will therefore be understood that this invention provides a simple inexpensive duct system for eliminating troublesome water seepage and leakage problems in basements and at the same time provides for expansion and contraction of a basement floor relative to the surrounding foundation walls.

I claim as my invention:

1. In combination with a building structure having a foundation wall supported on a footing and surrounding a floor, the improvement of an open top resilient duct, means mounting said duct on the inner face of the foundation wall with the top of the duct level with the top surface of the floor and surrounding the floor to act as an expansion joint between the foundation wall and the floor, and a drain for said duct at a lower level than the bottom of the duct.

2. The further improvement of claim 1 wherein the duct is composed of extruded plastic material, has a U-shape, has internal shoulders on the side legs thereof forming abutments and a cover is mounted in said duct on said abutments.

3. In combination with a building construction having a concrete footing, an upstanding concrete foundation supported on the footing, and a concrete floor covering the footing and spanning the foundation wall, the improvement of an open top resilient U-shaped duct surrounding the basement floor and abutted against the inner face of the foundation wall, with the open top of the duct flush with the top surface of the basement floor, the said duct acting as an expansion joint between the floor and the foundation wall, tubing at spaced intervals along the length of said duct draining said duct, and a drain tile under the basement floor receiving drainage from said tubing.

4. The additional improvement of claim 2 wherein said U-shaped duct has nozzles at spaced intervals along the length thereof receiving said tubing.

5. The additional improvement of claim 3 of an inverted U-shaped cover strip fitting in said duct and having an apertured top wall.

* * * * *